US008915166B2

(12) United States Patent
Buteaud et al.

(10) Patent No.: US 8,915,166 B2
(45) Date of Patent: Dec. 23, 2014

(54) SINGLE MOLD MILLING PROCESS

(75) Inventors: Scott Buteaud, Houston, TX (US); Cary Maurstad, Friendswood, TX (US)

(73) Assignee: Varel International Ind., L.P., Carrollton, TX (US)

( * ) Notice: Subject to any disclaimer, the term of this patent is extended or adjusted under 35 U.S.C. 154(b) by 1245 days.

(21) Appl. No.: 12/180,276

(22) Filed: Jul. 25, 2008

(65) Prior Publication Data

US 2009/0025984 A1 Jan. 29, 2009

Related U.S. Application Data

(60) Provisional application No. 60/962,414, filed on Jul. 27, 2007.

(51) Int. Cl.

| | |
|---|---|
| ***B21K 5/02*** | (2006.01) |
| ***E21B 10/43*** | (2006.01) |
| ***B22C 9/22*** | (2006.01) |
| *B22F 5/00* | (2006.01) |

(52) U.S. Cl.

CPC . *E21B 10/43* (2013.01); *B22C 9/22* (2013.01); *B22F 2005/001* (2013.01)

USPC ..... 76/108.2; 175/327

(58) Field of Classification Search

USPC ..... 76/108.1, 108.2; 175/432

See application file for complete search history.

(56) References Cited

U.S. PATENT DOCUMENTS

| | | | | |
|---|---|---|---|---|
| 4,991,670 | A * | 2/1991 | Fuller et al. | 175/428 |
| 5,056,382 | A | 10/1991 | Clench | |
| 5,358,026 | A | 10/1994 | Simpson | |
| 6,073,518 | A | 6/2000 | Chow et al. | |
| 6,164,394 | A * | 12/2000 | Mensa-Wilmot et al. | 175/331 |
| 6,353,771 | B1 * | 3/2002 | Southland | 700/197 |
| 6,454,030 | B1 * | 9/2002 | Findley et al. | 175/425 |
| 6,568,492 | B2 * | 5/2003 | Thigpen et al. | 175/408 |
| 6,655,481 | B2 * | 12/2003 | Findley et al. | 175/425 |
| 7,159,487 | B2 * | 1/2007 | Mensa-Wilmot et al. | 76/108.2 |
| 7,625,521 | B2 * | 12/2009 | Izaguirre et al. | 419/10 |
| 7,694,608 | B2 * | 4/2010 | Squier et al. | 76/108.2 |
| 7,703,557 | B2 * | 4/2010 | Durairajan et al. | 175/426 |

(Continued)

*Primary Examiner* — Kenneth E. Peterson
*Assistant Examiner* — Jennifer Swinney
(74) *Attorney, Agent, or Firm* — Gardere Wynne Sewell LLP; Andre M. Szuwalski

(57) ABSTRACT

A bit mold is milled using a turning stage which forms a base mold component and a base gagering component. Next, a blade milling stage is performed in which the base mold component and base gagering component are milled to define integral junkslot formers separated by blade regions. Lastly, a pocket milling stage is performed in which the blade regions and integral junkslot formers of the base mold component are milled to define a plurality of cutter pockets in primary and perhaps secondary rows. Each cutter pocket includes a seat portion and a face portion. The milling of the pocket milling stage provides, at one or more of the cutter pockets, a facet. This facet is provided in an area about the junkslot former associated with the face portion of the cutter pocket, the face portion having, due to the presence of the facet, a surface for matching a cutter core displacement end surface without voids of a size which would require the use of fill material. The facet is also provided on either side of the pocket associated with the seat portion to avoid the need to clay the sides of the displacement for providing top-loading clearances. The milling process at the pocket milling stage further supports definition of relief and erosion resistance features in the mold.

23 Claims, 12 Drawing Sheets

(56) References Cited

U.S. PATENT DOCUMENTS

| | | | | |
|---|---|---|---|---|
| 7,726,415 | B1 * | 6/2010 | Tipton et al. | 175/39 |
| 7,762,355 | B2 * | 7/2010 | McClain et al. | 175/57 |
| 7,784,567 | B2 * | 8/2010 | Choe et al. | 175/374 |
| 7,802,495 | B2 * | 9/2010 | Oxford et al. | 76/108.2 |
| 7,841,259 | B2 * | 11/2010 | Smith et al. | 76/108.2 |
| 7,913,779 | B2 * | 3/2011 | Choe et al. | 175/374 |
| 2002/0020565 | A1 * | 2/2002 | Hart et al. | 175/385 |
| 2002/0175006 | A1 * | 11/2002 | Findley et al. | 175/425 |
| 2006/0260845 | A1 * | 11/2006 | Johnson | 175/331 |
| 2007/0079995 | A1 * | 4/2007 | McClain et al. | 175/426 |

* cited by examiner

SINGLE MOLD MILLING PROCESS

PRIORITY CLAIM

The present application claim the benefit of U.S. Provisional Application for Patent No. 60/962,414 of the same title filed Jul. 27, 2007, the disclosure of which is hereby incorporated by reference.

BACKGROUND OF THE INVENTION

1. Technical Field of the Invention

The present invention relates generally to the manufacture of earth boring bits, and more particularly to the manufacture of rotary bits through a molding process.

The present invention relates to a process utilized to manufacture rotary bits for drilling subterranean formations, as well as features created therein, by utilizing CNC machining to create one or more graphite parts used to cast the bit matrix with a single mold assembly. Such as assembly advantageously eliminates the need for multiple prefabricated components and artwork, such as performs and clay filling, as is known and used in the prior art fabrication process.

2. Description of Related Art

Fixed cutter drill bits known in the art include polycrystalline diamond compact (PDC) bits. The typical PDC bit includes a bit body which is made from powdered tungsten carbide infiltrated with a binder alloy within a suitable mold form. The particular materials used to form PDC bit bodies are selected to provide adequate toughness, while providing good resistance to abrasive and erosive wear. The PDC cutting elements used on these bits are typically formed from a cylindrical tungsten carbide substrate. A diamond table made from various forms of natural and/or synthetic diamond is affixed to the substrate. The substrate is then generally brazed or otherwise bonded to the formed bit body in a selected position on the surface of the body.

The materials used to form PDC bit bodies, in order to be resistant to wear, are very hard and are therefore difficult to machine. The shape and configuration of the bit bodies must accordingly, in most cases, be substantially defined during the bit body molding process. More specifically, the mold used in the molding process defines the size and shape of the gage of the bit body. The mold used in the molding process further defines the number and shape of the blades of the bit (along with the associated junkslots). Still further, the selected positions in the blade at which the PDC cutting elements are to be affixed to the bit body are also typically defined by the mold and formed substantially to their final shape during the bit body molding process.

Reference is now made to FIG. 1A which illustrates a junkslot plug mold 10 and to FIG. 1B which illustrates a junkslot plug 12, these mold structures being well known to those skilled in the art for use in producing a preform. When building a drill bit mold in accordance with known techniques of the prior art, the junkslot plug mold 10 and a junkslot plug 12 are machined in accordance with a desired design and specification. The junkslot plug 12 is placed within the junkslot plug mold 10 (turned upside down from what is shown in FIG. 1B) and the resulting assembly is then infiltrated with resin-coated sand that fills the open spaces 14 within mold 10 as defined by the shape of the plug 12. When the resin-coated sand cures, the junkslot plug can be removed from the mold.

The result of this preform molding process is shown in FIG. 2, where the material 16 as removed from the plug mold 10 is the cured resin-coated sand (which filled the open spaced 14 in the mold) and the material 18 is junkslot plug 12 which was inserted into the mold 10. The cured resin-coated sand material 16, after molding, becomes a set of sand junkslot formers 20. The material 16 for the sand junkslot formers 20 is carefully removed from the junkslot plug 12 material 18 for subsequent use in the actual bit mold from which the bit is cast. This will be described in more detail below. What is important to consider is the time, effort and expense which is expended in connection with defining and producing the sand junkslot formers. There would be an advantage if the perform molding process for producing the sand junkslot formers could be eliminated.

Reference is now made to FIG. 3 which shows how the sand junkslot formers 20 have been inserted into a bit mold 26 from which an actual bit will be created. The bit mold 26 includes a bottom portion 30 into which a number of cutter pockets 32 have been formed and an upper portion 36 (having a ring shape) defining the gage of the bit. Each cutter pocket includes a seat 37 and a face 39. The bottom and upper portions 30 and 36 of the bit mold 26 are assembled together as shown, and the sand junkslot formers 20 are then securely inserted into the assembled mold 26 in proper alignment with the cutter pocket 32 locations. More specifically, the sand junkslot formers 20 are positioned between sets of adjacent cutter pockets 32 to define the location of the junkslots for the bit and thus further define the shape of the bit blades associated with each set of cutter pockets.

Although described above in the context of forming junkslots, it is well known in the art that other preform pieces can be cast in the manner described using resin-coated sand. Such preforms are employed to define, in addition to junkslots, the internal fluid passages to deliver drilling fluid to the bit face, as well as cutter pockets, cutter faces, and nozzle displacements.

Reference is now made to FIG. 4. At this point in the bit manufacturing process, a cutter shaping element called a "displacement" 40 is installed in the bit mold at each of the formed cutter mounting positions (i.e., the cutter pockets 32). The displacement 40 is a cylindrical graphite piece which represents a PDC cutter. This displacement is placed resting in the seat 37 at each of the cutter pocket 32 location and is secured in a position such that a first end 41 of the displacement rests against the face 39 of the pocket facing towards the sand junkslot former 20. Each displacement 40 has the same size and shape as the polycrystalline diamond compact cutter which has been designated for use at that pocket 32 in the to-be-molded bit. Thus, the displacement 40 is used to form the shape of the PDC cutter mounting positions during the bit body molding process.

To extent there are any imperfections in the bit mold, for example due to problems with the size, shape and/or configuration of the sand junkslot formers 20, or for example due to problems with the relationship between the installed sand junkslot formers 20, cutter pockets 32 and installed displacements 40 (for example, at the seat 37 or face 39), these imperfections must be addressed prior to molding. It is common in the art to use a clay material 44 to fill any noted voids, misalignments, imperfections, and the like, in the bit mold. For example, clay 44 can be used to fill voids between the front first end 41 of the installed displacement 40 and the installed sand junkslot former 20 (generally at the seat 37 or face 39 locations). Clay 44 can also be used to fill the space between the installed sand junkslot formers 20 and the bottom and upper portions (30 and 36, respectively) of the mold. Imperfections, undercuts, edges, and the like may also be addressed through the selective application of filling clay 44.

The molded bit includes a bit body formed using a matrix of hard particulate material, such as tungsten carbide, that is infiltrated with a binder, generally copper alloy or similar material. The bit body is cast around a cylindrical piece of steel, also known as "blank," which is used for internal reinforcement of the bit body matrix. The blank, along with the sand pieces and graphite cutter displacement cores, are placed in the mold in order to cast the bit. This assembly of components is then filled with tungsten carbide powder that is infiltrated with binder in a furnace. During cooling, the matrix bonds to the blank. Once the assembly has cooled, the graphite of the mold 26 is chipped away and all of the sand preforms (such as junkslot formers 20), clay 44 artwork, and graphite cutter cores (displacements 40) are removed and cleaned away leaving the bit body. A threaded pin connection, also termed an "upper section", is then welded to the blank of the bit body. The upper section is used to attach the bit to the drive apparatus, normally a drill collar or a downhole motor. The PDC cutting elements are then bonded to the bit face, in the openings left by the removed displacements, by brazing. The process for casting the bit as described in this paragraph is well known to those skilled in the art.

The building process to fabricate a matrix drill bit is very costly and quite complex. This process requires the fabrication of a mold that is then used to cast the bit. The blank and sand pieces are individually designed and fabricated, and the design and configuration of these components are often times revised thus requiring costly production time in lieu of process adjustments that are needed to introduce new and different preforms. For many years, bit molds have been machined to a standard bit profile. Sand preforms cast from the junkslot plug are then glued between each blade location in the mold in reverse, along with all other graphite plugs and sand performs, by skilled technicians employing various files and sculpting tools. These technicians also employ the use of a special bit molding clay comprised of graphite powder, bee's wax, and permaplast modeling clay. This clay is used to correct any imperfections in the mold. There is a need in the art for a simpler, less expensive, and more accurate process for bit mold creation.

Reference is also made to U.S. Pat. Nos. 5,358,026, 6,073,518, and 7,159,487, the disclosures of which are hereby incorporated by reference herein.

SUMMARY OF THE INVENTION

In an embodiment, a method for manufacturing a drill bit mold comprises: milling into a mold component a set of junkslot formers separated by blade regions; milling into the blade regions a plurality of cutter pockets each comprising a seat portion and a face portion, wherein the milling provides, at one or more of the cutter pockets, a facet located in an area about the junkslot former associated with the face portion of the cutter pocket; and installing a cutter core displacement at the one or more of the cutter pockets, the cutter core displacement have an outer surface conforming to the seat portion and an end surface which, due to the presence of the facet, matches the face portion and obviates need for the use of material to fill any voids between the end surface of the installed cutter core displacement and the face portion of the cutter pocket.

In an embodiment, a method for manufacturing a drill bit comprises: forming a drill bit mold, filling the drill bit mold with a casting material, removing the drill bit mold to release a cast object, and replacing the cutter core displacements in the cast object with PDC cutter elements. The step of forming a drill bit mold comprises: milling into a mold component a set of junkslot formers separated by blade regions; milling into the blade regions a plurality of cutter pockets each comprising a seat portion and a face portion, wherein the milling provides, at one or more of the cutter pockets, a facet located in an area about the junkslot former associated with the face portion of the cutter pocket; and installing a cutter core displacement at the one or more of the cutter pockets, the cutter core displacement have an outer surface conforming to the seat portion and an end surface which, due to the presence of the facet, matches the face portion and obviates need for the use of material to fill any voids between the end surface of the installed cutter core displacement and the face portion of the cutter pocket.

In an embodiment, a method for milling a bit mold comprises: a turning stage in which a first material block is turned to form a base mold component and a second material block is turned to form a base gagering component; a blade milling stage in which the base mold component and base gagering component are milled to define integral junkslot formers separated by blade regions; and a pocket milling stage in which the blade regions and integral junkslot formers of the base mold component are milled to define a plurality of cutter pockets each comprising a seat portion and a face portion, wherein the milling provides, at one or more of the cutter pockets, a facet located in an area about the junkslot former associated with the face portion of the cutter pocket, the face portion having, due to the presence of the facet, a surface for matching a cutter core displacement end surface without voids of a size which would require the use of fill material.

BRIEF DESCRIPTION OF THE DRAWINGS

The present invention will now be illustrated, by way of non-limiting examples, through a description of embodiments with reference to the drawings in which.

DETAILED DESCRIPTION OF THE DRAWINGS

Figure 1A:
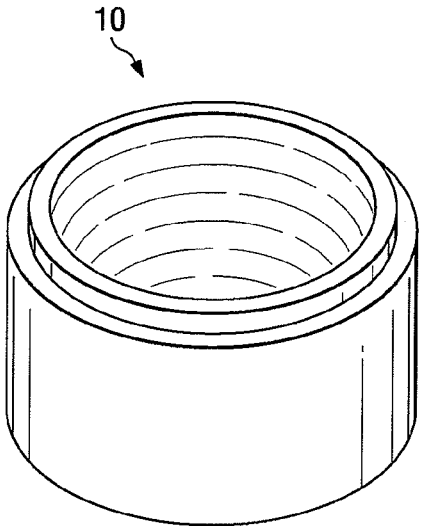
FIG. 1A (PRIOR ART)
FIG. 1A illustrates a junkslot plug mold.
Figure 1B:
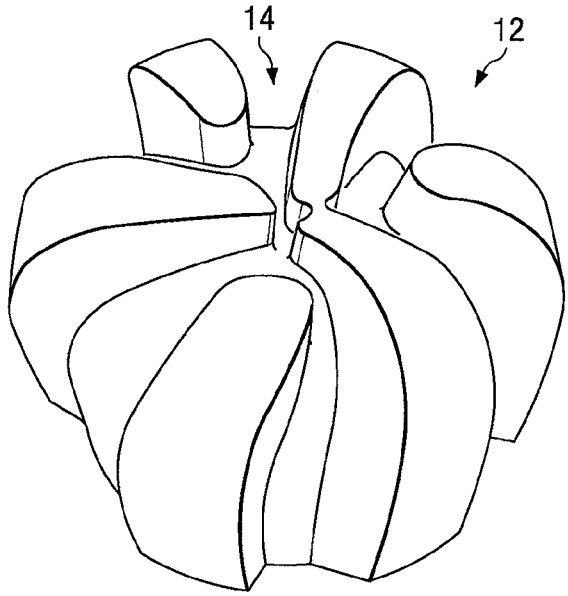
FIG. 1B (PRIOR ART)
FIG. 1B illustrates a junkslot plug which fits into the mold of FIG. 1A.
Figure 2:
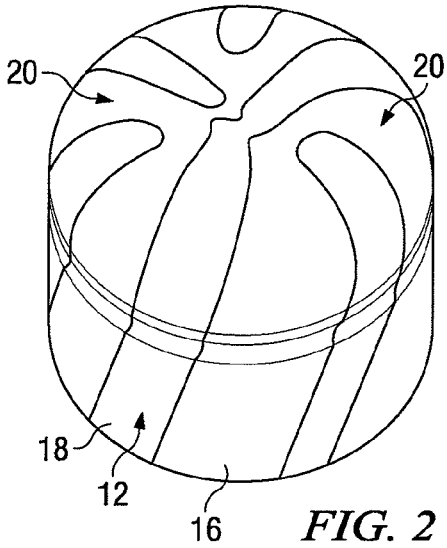
FIG. 2 (PRIOR ART)
FIG. 2 illustrates the molded output of junkslot formers.
Figure 3:
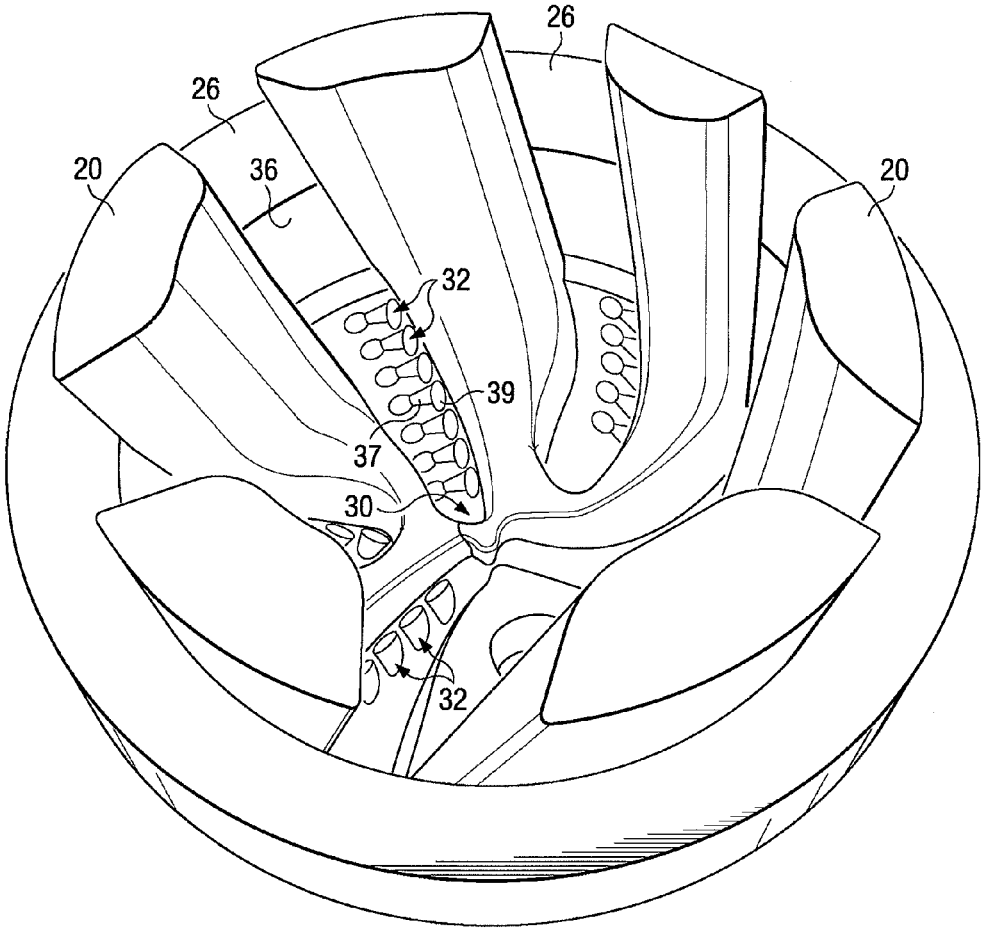
FIG. 3 (PRIOR ART)
FIG. 3 illustrates sand junkslot formers inserted into a bit mold.

Embodiments described herein suggest a method of building matrix-type rotary bits for subterranean drilling without the need for any sand preforms or modeling clay as employed in the prior art for creation of the bit profile, junkslot area, and cutter pocket faces. These embodiments, by eliminating the need for junkslot sand preforms, also eliminate the need for the use of additional graphite junkslot plug and mold techniques which are required to cast the sand junkslot formers. The embodiments also contemplate a substantial reduction of skilled labor to "sculpt" the final mold, such as with the use of clay to address imperfections, prior to casting the bit. Sand preforms may be used to define the fluid passages if needed.

A focus of the embodiments disclosed herein is the fabrication of the overall bit mold without the use of sand junkslot pieces or sand preform cutter faces. A bit, and its associated bit mold, is designed using a 3D solid modeling software, which provides the designer the ability to configure the size of the bit, all internal and external features of the bit, such as fluid passages, blank location, cutter sizes, back rakes and locations as well as height, thickness, profile and orientation of cutter backup features on the bit face and the depth and profile of the waterways and junkslots on the bit face and gage.

In an embodiment, in this CAD model, a small bump, also termed as "cutter facet," is created in the design of the bit mold at each cutter location. In one embodiment, this facet is associated with primary cutter rows and is located parallel to the cutter face position on the blade tops to ensure that once the cutter pocket is machined for that bit mold design, that the bit mold for the entire cutter face will be fully machined thus eliminating the need to use clay in the bit mold to correct for imperfections at each cutter core position with respect to the junkslot former. In another embodiment, this facet is associated with secondary cutter rows and is located on either side of the machined cutter pocket on the blade tops to ensure ease of top loading and the elimination of clay sculpting to ensure sufficient side clearances.

Once the design work for the bit mold is complete, the design CAD model is transferred to a CNC programmer. This CAD model is then added to a manufacturing assembly in a CAM (Computer Aided Manufacturing) system. The CAM system is used to mill the required parts of the bit mold in a number of stages; namely, a turning stage, a blade milling stage and a pocket milling stage. In the turning stage, the CAM system operates on two distinct graphite pieces (starting for example from blocks) which will be used to form the bit mold in order to form the main body diameter and configuration of the bit. A first piece, referred to herein as the mold component, is used to define and form the bit face. A second piece, referred to herein as the gagering component, is used to define and form the gage area of the bit. The CAM system will turn each of the two distinct graphite pieces/blocks to make a first, rough, pass at removing unwanted graphite material and to further define complementary seating and sealing surfaces that will allow mating between the mold component and the gagering component. This turning operation generally defines in the two components the location and presence of the junkslot formers.

Once the turning stage is completed, the mold component part is loaded into a CNC 5-axis Milling Machine for execution of the blade milling stage. The CNC machine will then mill the bit blades into the mold component along with the aforementioned facets. Holes are also plunge milled in the mold component to provide a location for the nozzle cores to be attached.

Following completion of the blade milling state, the CNC machine further executes the pocket milling stage. In this stage, the CNC machine mills the cutter pockets into the mold component (and the gagering component, if needed). These pockets are sized and shaped to received desired displacements.

It will accordingly be recognized that use of the three stage milling process advantageously fully defines the gage, blades, junkslot formers, facets and cutter pockets with respect to the entire mold component and gagering component. Fabrication of the bit is then completed in accordance with the process known in the art (and generally described above). However, because of the milling of the cutter pockets and facets as described, installation of graphite cutter cores (displacements) in the bit mold prior to bit casting can be easily completed without the need or use of sculpted clay to address imperfections, undercuts, edges, clearance assurances, and the like. There is accordingly a significant labor cost savings in connection with the use of the foregoing method to prepare a mold for bit casting.

Another feature of the disclosed embodiments relates to a design and manufacturing method with respect to mold creation which can provide for selecting among different types of cutter pockets to receive displacements. Three different types of pockets are selectable at the bit/mold design stage for inclusion in the bit mold, and more specifically in the mold component. The three pockets are: an erosion-resistant pocket, also termed an "ER Pocket"; an undercut pocket, also termed "UC Pocket"; and a standard pocket which is provided without any undercut or erosion-resistant features. All three types of pockets are defined by a set of design features, created in the CAM system, that can be placed on the blade on a per cutter location basis on the primary row during the pocket milling stage, and each pocket takes advantage of the facet feature which supports a more efficient displacement installation. A different set of features may be chosen and provided with respect to the secondary row, if included.

The design of the ER Pocket mills a feature at the selected pocket location on the mold component by removing graphite material so as to add a hump of molded bit matrix material to the innermost edge or end of the blade for the cast bit, that edge/end being associated with an innermost side of the innermost installed PDC cutter. The ER pocket feature is commonly used on bits that have secondary blades (i.e., a short blade that does not start adjacent to the center of the bit) and is primarily used on the innermost portion of the first cutter location of each secondary blade in order to protect the first cutter from erosion when using very abrasive drilling fluid.

The design of the UC Pocket mills a feature at the selected pocket location on the mold component to leave graphite material on the mold around a portion of the pocket location so as to provide a "relief" bevel in the cast bit matrix around the diamond table of an installed PDC cutter at that pocket location. This relief bevel allows the diamond table of the installed PDC cutter to have some perimeter clearance with respect to the bit matrix in order to address concerns with diamond table breakage when drilling in hard formations.

The design of the Standard Pocket does not include either an erosion protection (hump) feature or an undercut (relief bevel) feature. This pocket design is for used in standard applications. The graphite mold is milled to substantially, if not exactly, match or conform to the PDC to be installed in the cast bit.

Importantly, the molding design requirements for each of these pockets (removing or leaving graphite mold material during milling) are created in connection with the bit/mold design as standard milling features which can be selected by the bit designer for placement at any specified cutter location. The choice of pocket design, for a given pocket location, is specified the manufacturing assembly specification for the CAM (Computer Aided Manufacturing) system. Implementation of any of the pocket features is accomplished in accordance with the same methods and techniques described previously.

By using the CAM system, a group of machining sequences are created as a set. Internal of this set is the definition of the actual tool path, tool definition and machine parameters required to machine the aforementioned pocket shape (as well as machine other features in the mold such as the junkslot former and facets). Each set also incorporates the ability to place the group in a set of positions directly related to the drill bit cutting structure file. This ensures that the cutter displacement cores are placed in the proper location according to the cutting structure designed in the bit.

An advantage of the process disclosed is the elimination of the costly time and material involved with the creation of a junkslot plug for each new bit design. In the past, each new bit design required the machining of a junkslot plug and mold, from graphite bar stock, that was then used to cast the sand preforms that were assembled into the mold to create the blades of the bit. With the disclosed process, the blades of the bit are milled entirely into the mold using a 5-AXIS CNC Machine, thus eliminating the costly graphite material and machine time associated with the junkslot plug method of rotary bit mold building.

Another benefit is the elimination of the man hours associated with the installation and sculpting of clay in the prior art when assembling the cutter cores, sand preforms and displacements in the mold. By using any of the three pocket machining methods, as described herein, there is no need for clay installation in connection with the included cutter displacements and junkslot formers because the facet presents a milled shape creating the ability to achieve a full cleanup of the cutter pocket face with an installed displacement core, thus providing the cutter displacement core with a matching surface in the cutter pocket and junkslot former against which the core can seat.

Figure 5:
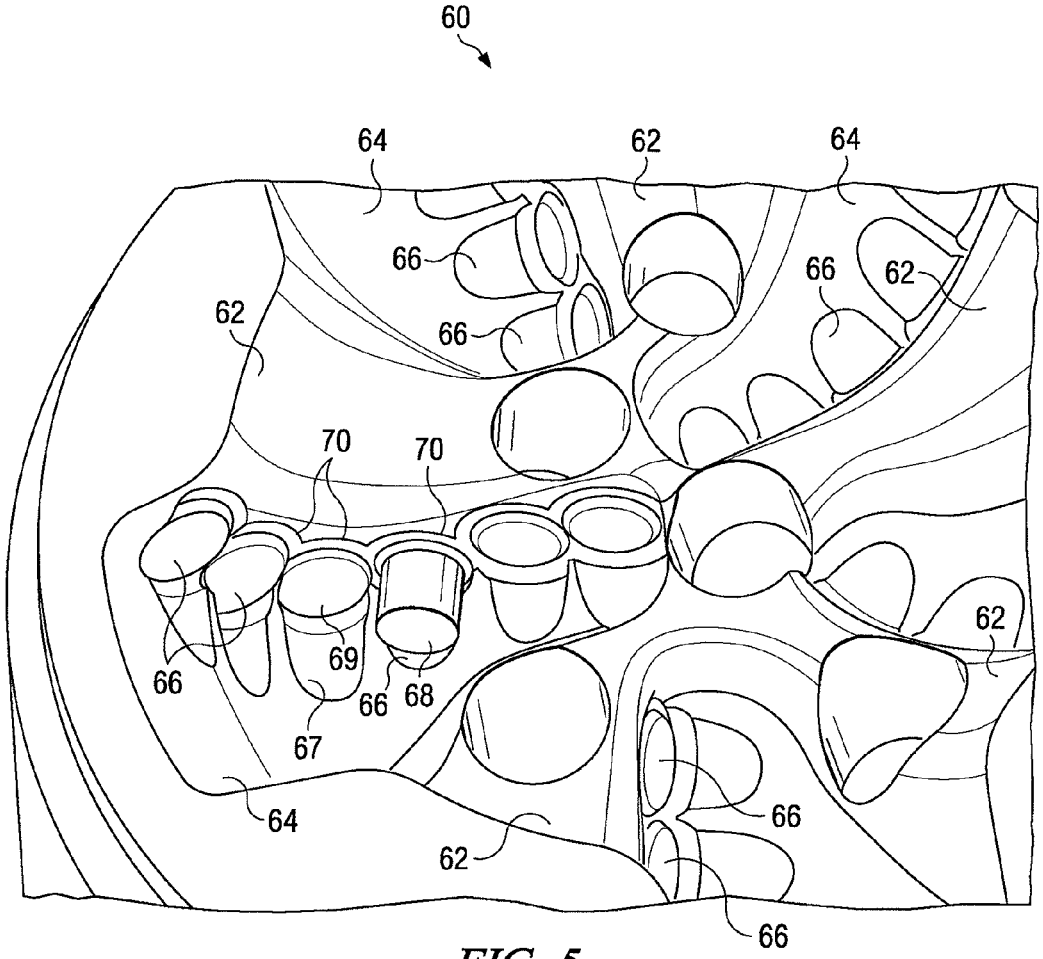
FIG. 5 illustrates a mold component (bottom portion) of a bit mold in accordance with an embodiment.

Reference is now made to FIG. 5 which shows a bottom portion (i.e., the mold component 60) of the bit mold. It will be noted that FIG. 5 illustrates that the junkslot formers 62 have been machined into the bottom portion mold component 60. No use of sand junkslot formers, or performs associated with defining the junkslot, as in the prior art is necessary. It will also be noted that, through the machining of the junkslot formers 62 into the graphite mold component 60 itself, that the mold component 60 further includes openings (or cavities) 64 which define the size, shape, number and orientation of the blades of the to-be cast bit. A number of cutter pockets 66 have also been formed by the machining process, each pocket including a seat 67 and a face 69. FIG. 5 further shows, to assist in better understanding the configuration of the bottom portion mold component 60 of the bit mold as a result of the machining process, the installation of a graphite displacement 68 in one of the cutter pockets 66 (the cylindrical circumferential surface of which resting in the seat 67 and the circular end of which resting against the face 69). It will be noted how, due to the controlled milling process, the graphite displacement 68 closely conforms to the shape of the machined cutter pocket 66 (especially at the face 69) without imperfection which would otherwise require clay filling and sculpting. FIG. 5 still further shows, at certain cutter pocket 66 locations, the presence of a relief feature 70 (comprising graphite material left on the mold around a portion of the pocket location) associated with the provision of a UC pocket.

Figure 6:
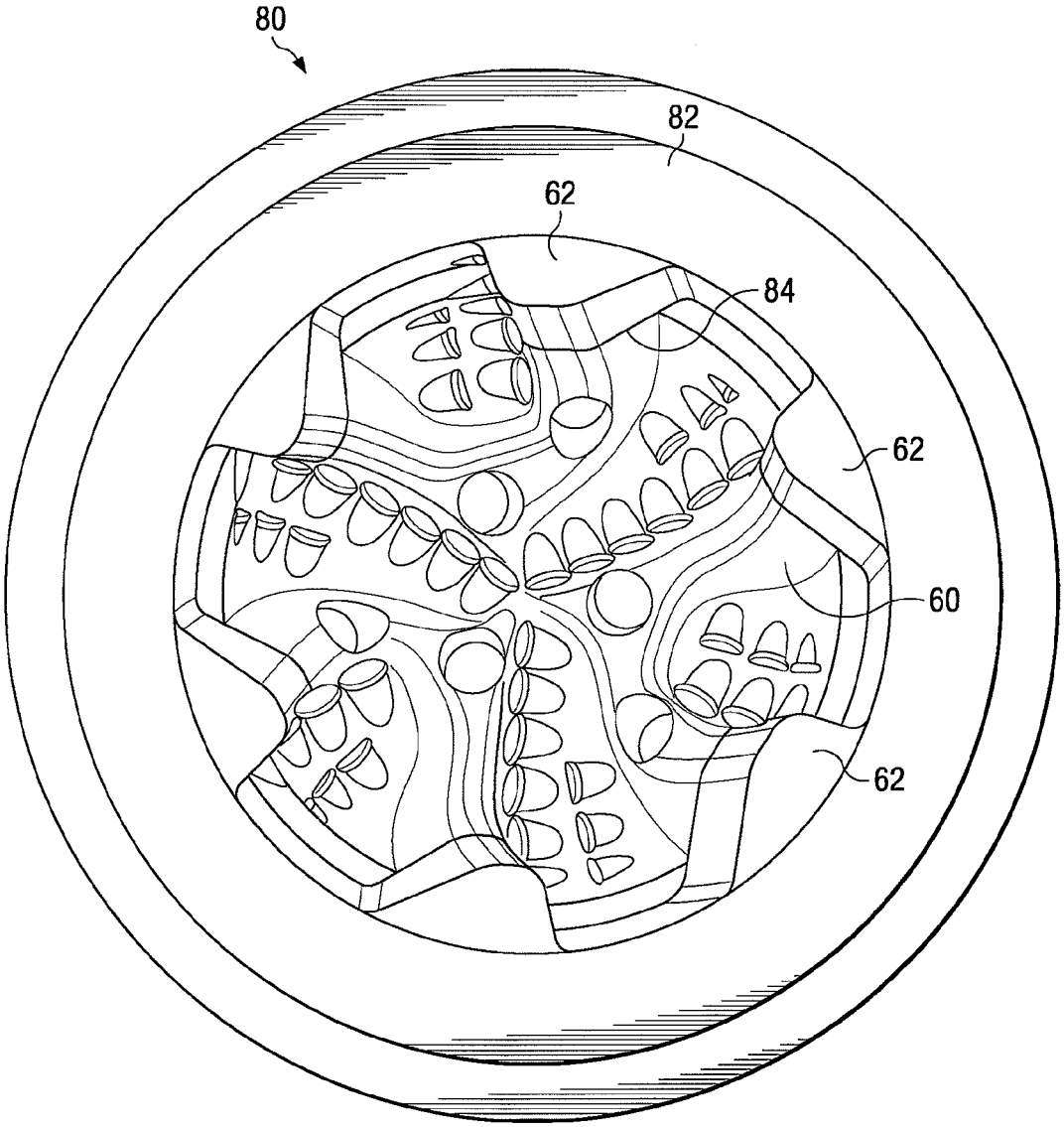
FIG. 6 illustrates an assembled bit mold.

Turning next to FIG. 6, there is shown an assembled bit mold 80 comprising bottom portion (mold component 60) and an upper portion (gagering component 82). The bit mold 80 is a graphite mold manufactured using the milling process described herein. FIG. 6 shows the completed mold component 60 and gagering component 82 assembled together. The bottom mold and upper gagering pieces are machined in the manner described above from graphite stock material. It will be noted that the mold component 60 has a different design and configuration (junkslot number and location, blade number and orientation, cutter pocket number and position) than the mold component 60 of the bit mold shown in FIG. 5. This illustrates how the machining process can be used to easily create molds for different bit designs. Each of the two mold component 60 bottom portions shown in FIGS. 5 and 6 can be machined in a similar way but with different design specifications. In each case, as discussed above, the junkslot formers 62 have been machined into the mold component 60 itself, thus obviating the need to use separately installed sand junkslot formers as in the prior art. FIGS. 5 and 6 both show holes which have been plunge milled into the bottom portion to locate nozzle cores used to form the drilling fluid passages. FIG. 6 further illustrates the location of the parting line 84 between the bottom portion mold component 60 and the upper portion gagering component 82 of the bit mold 80. In connection with the upper portion gagering component 82 it will be noted that it, like the bottom portion mold component 60, has been machined in accordance with the process described herein to include junkslot formers 62 which align with the junkslot formers 62 located in the bottom portion mold component 60. Again, this fully obviates the need to design, manufacture and install sand junkslot formers within the mold.

Figure 7:
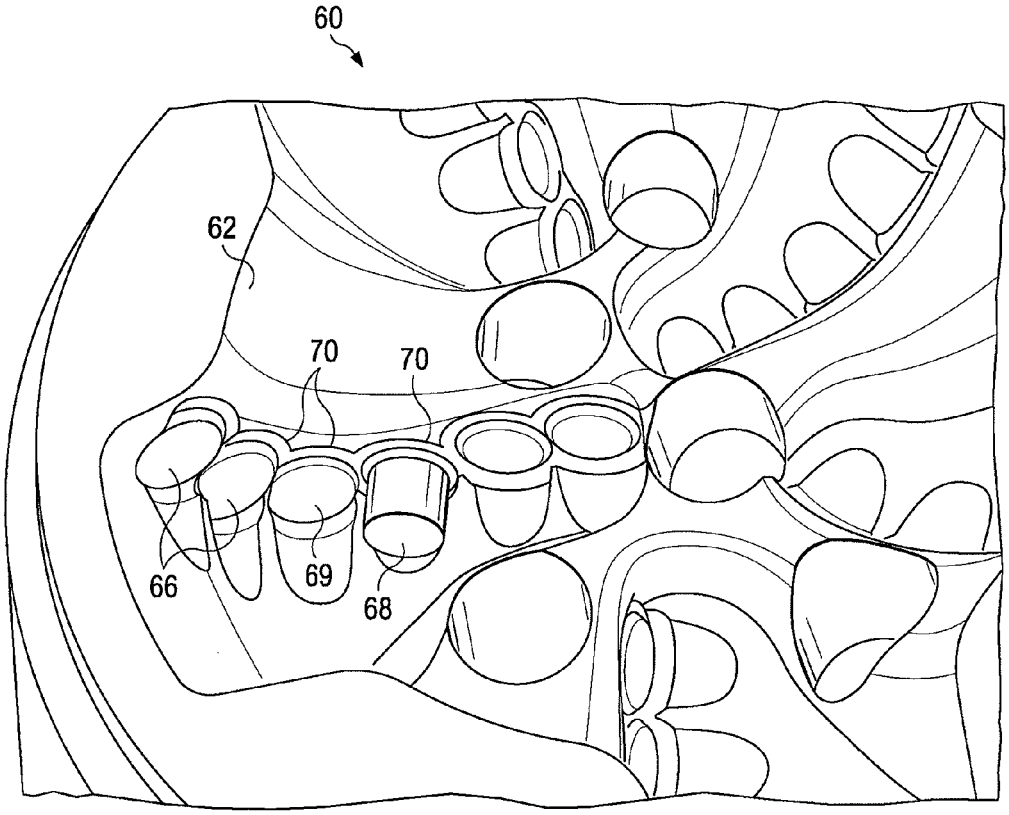
FIG. 7 illustrates another view of FIG. 5.
Figure 15A:
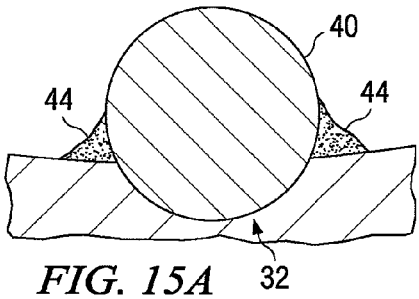
FIG. 15A (PRIOR ART)
FIG. 15A is a cross-section view of part of a prior art bottom portion mold component associated with a secondary row of cutter pockets.

Reference is now made to FIG. 7 which is another view of the mold component 60 shown in FIG. 5. Again, this is a graphite mold component 60 manufactured using the milling process described herein. The illustration in FIG. 7 focuses on an undercut (or "UC") pocket type which has been formed through the milling process. It will be noted that a single graphite displacement 68 cutter core has been positioned into a cutter pocket 66 within the mold. The illustrated relief feature 70 (see also FIG. 5) created for the PDC cutter at a pocket location is not formed using the cutter core displacement 68, but is instead formed by milling the mold to leave graphite material at the face 69 and with respect to the facet around a peripheral portion of the pocket location. A shortened standard cutter core is installed in the pocket (see, also FIGS. 15A and 15B). The effect is that end portion of the cutter core displacement nearest the junkslot former, which is not present on the core itself because of the use of a shortened core, is actually formed in the graphite mold itself by the un-milled graphite material around face 69 of the pocket location. For further information on the benefits which accrue from the presence of a relief bevel on the cast bit, arising from use of the mold relief feature 70, see U.S. Pat. No. 7,159,487, the disclosure of which is hereby incorporated by reference.

Figure 8:
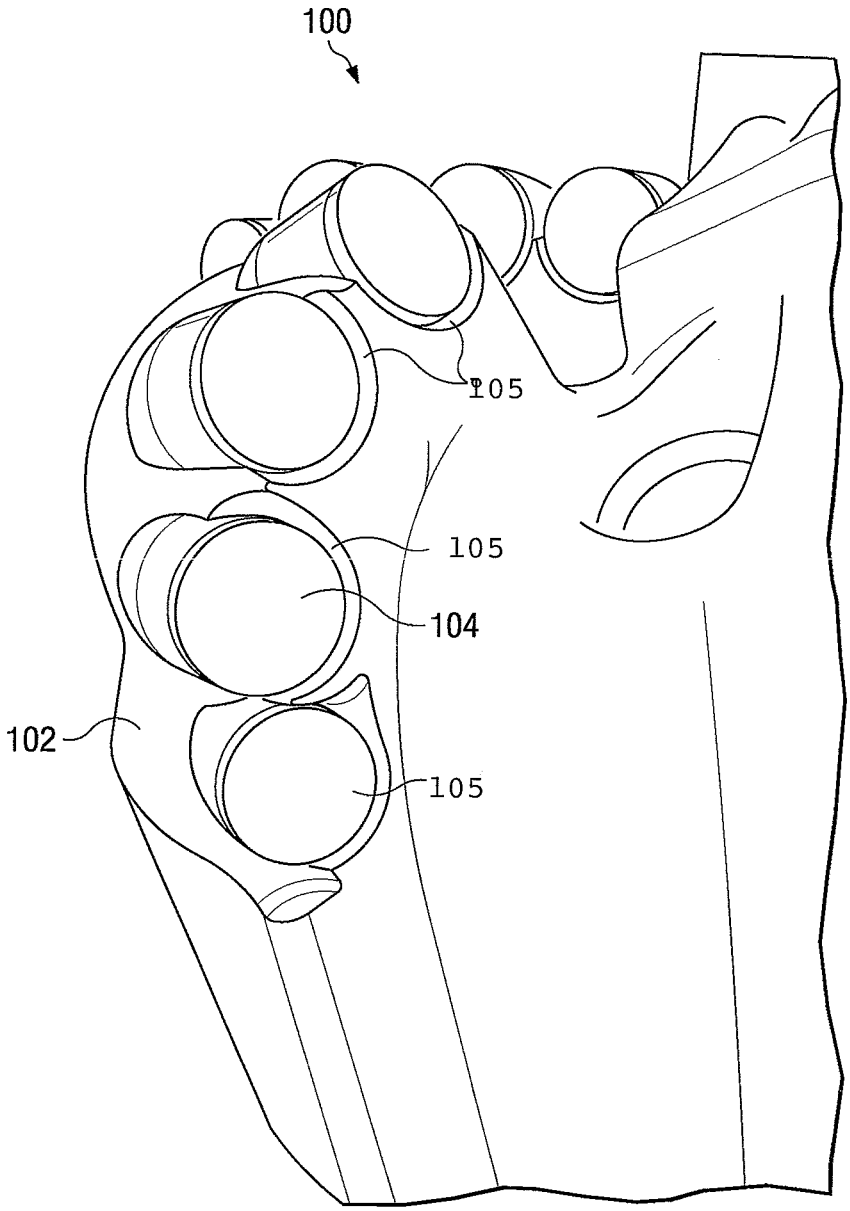
FIG. 8 illustrates a finished cast bit.

A better understanding of the relief feature 70 and its effect on the resulting cast bit may be obtained by referring to FIG. 8. FIG. 8 illustrates a finished bit 100 that was cast from a mold manufacture using the milling process described herein to include an "UC" pocket. FIG. 8 shows a close-up view of the bit blade 102 with the PDC cutters 104 installed. It will be noted that the relief feature 70 which was machined into the graphite mold component 60 produced a relief bevel 105 in the cast bit around the front face of the installed PDC cutter 104 when the PDC cutter of a longer length than the displacement core is brazed to the bit. By designing the correct machining process, any suitable relief feature 70 can be machined into the mold to produce a corresponding desired relief bevel 105. This obviates the need to define such a relief feature in the bit mold using, for example, sculpted clay or some other technique or through the incorporation of the relief feature in the displacement 68 itself as is known in the prior art.

Figure 9:
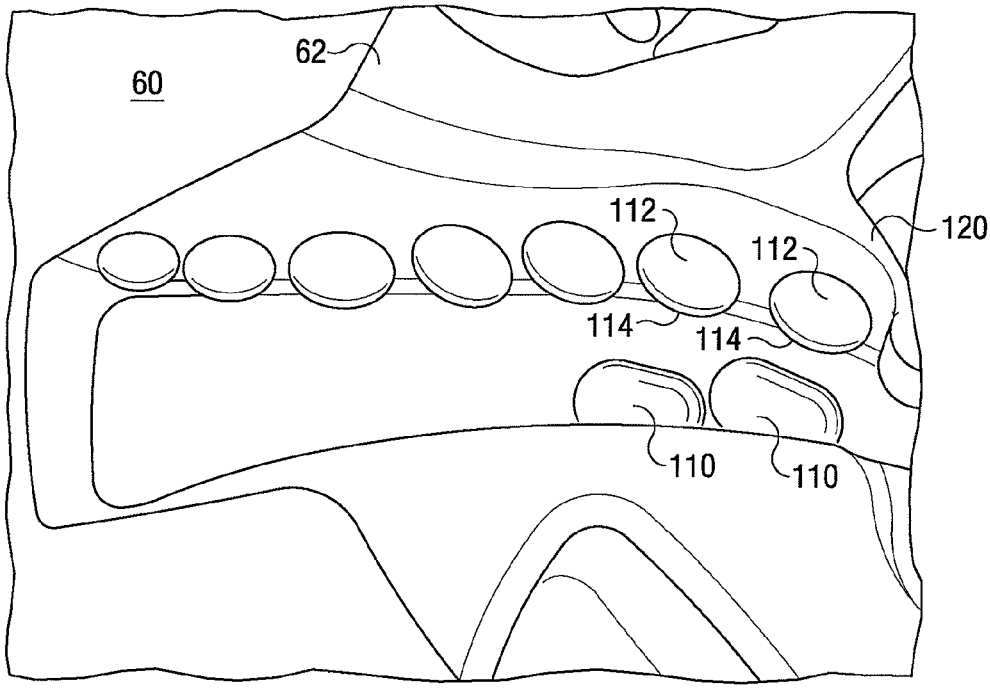
FIG. 9 illustrates a mold component (bottom portion) prior to completion of the pocket milling process.

Reference is now made to FIG. 9 which illustrates a bottom portion mold component 60 of the bit mold at a point in time during the milling process prior to completion of the machining of the cutter pockets. The general shape, configuration and orientation of the blades, as well as the junkslot formers, has already been machined in the graphite at this point. The next machining step after this would be to machine each cutter pocket at the correct location and with the correct orientation and shape. It will be noted that shock stud bump features 110, also known as cutter backup features, have already been machined into the mold to produce shock studs behind certain cutter locations. Additionally, a facet 112 has been milled in the blade area at each cutter location 114. This facet 112 is used to achieve a "clay-less" cutter core displacement assembly (i.e., the facet provides non-milled graphite material in the mold itself at cutter pocket locations near where the face 69 will be located which obviates the need to install and sculpt clay on the mold in order to address mold imperfections relating to the positional relationship between the front of the displacement and face/junkslot former). The next step in the milling process would be to mill the cutter pockets themselves at the locations 114.

Figure 4:
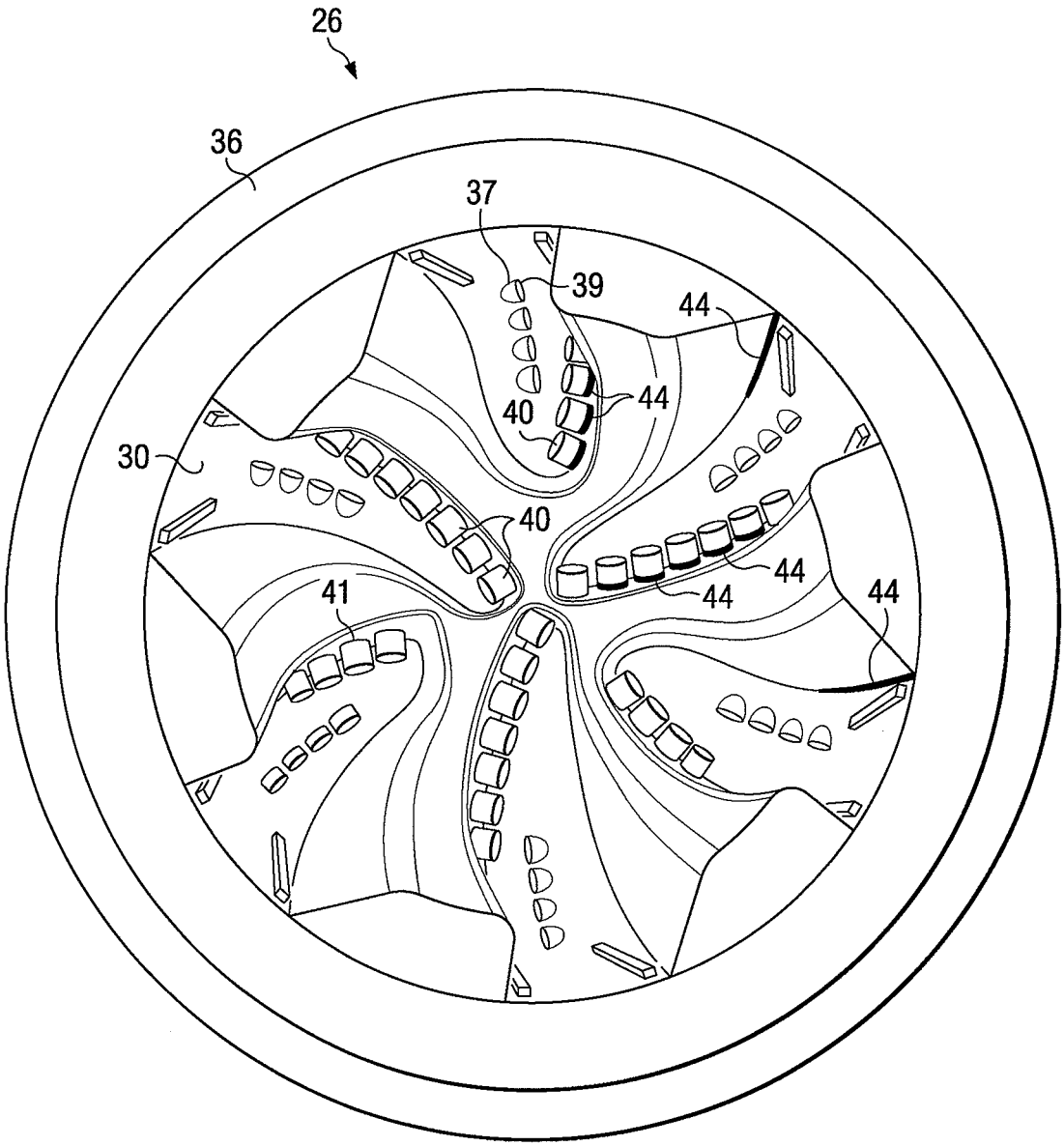
FIG. 4 (PRIOR ART)
FIG. 4 illustrates a bit mold with installed sand junkslot formers, installed displacements and installed clay to address imperfections.
Figure 10:
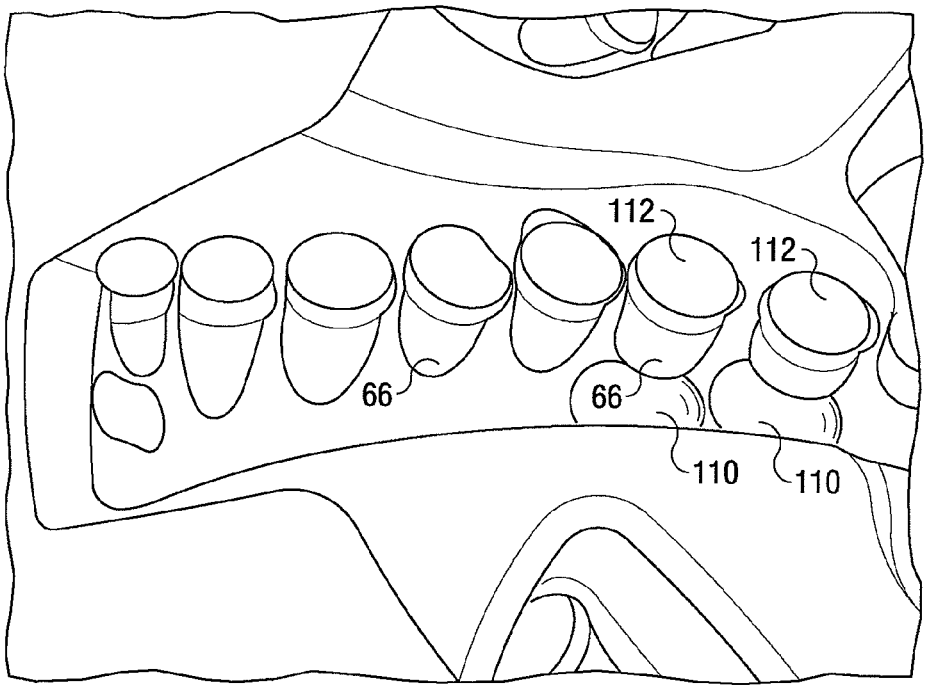
FIG. 10 illustrates a mold component (bottom portion) after completion of the pocket milling process.

FIG. 10 shows the bottom portion mold component 60 of FIG. 9 after completion of the machining operation as defined by the previously described milling process to create cutter pockets 66 along a given blade. In this case, a close-up view is presented of a "STANDARD" pocket type after the pocket is machined. It will be noted that by utilizing the pocket manufacturing method described herein, in conjunction with the facet 112 as described above, a conforming or matching surface for the face 69 is provided in the cutter pocket against which to mount (for example, glue) the cutter displacement core in relationship to the junkslot former. The non-milled material of the facet 112 is shaped in accordance with the displacement to minimize, if not eliminate, the risk of any voids or defects (imperfections) that, following displacement core installation, would require clay installation or sculpting to repair. In other words, because the machining used not only carefully defines the shape of the cutter pockets 66 but also carefully defines the shape of the face/junkslot formers (and their relationship to the cutter pockets), the milling process creates cutter pockets whose size and shape substantially matches the to-be installed displacements without necessitating clay fill (compare to FIG. 4 and the illustrated need to clay fill between displacements and the sand junkslot formers).

Figure 11:
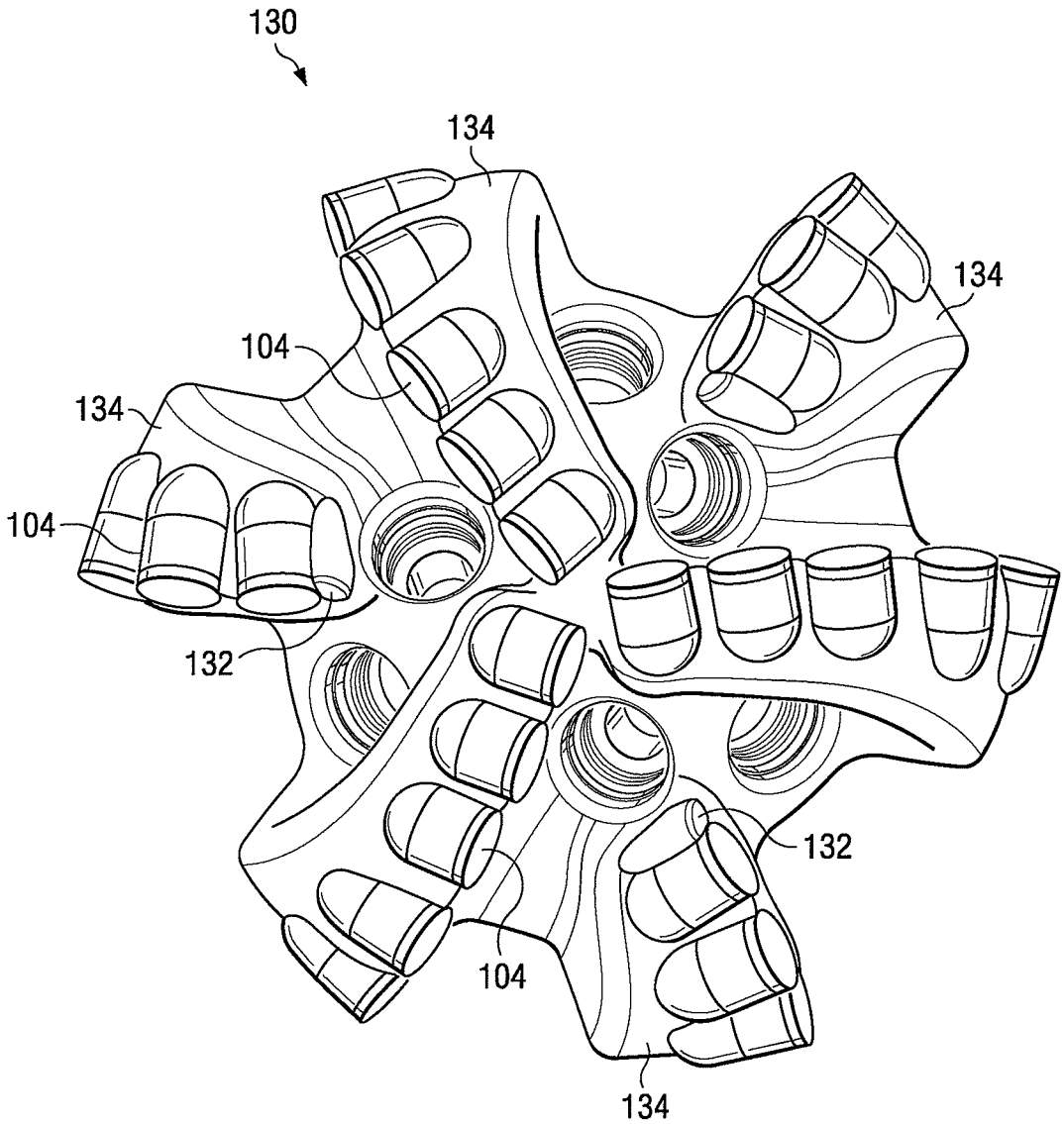
FIG. 11 illustrates a finished cast bit.

With reference once again to FIG. 9, the machining process can further selectively machine away an amount of graphite material in a region 120 to the right (or inside) of the region where the cutter facets have been defined (i.e., toward the center of the mold on the defined blade) in support of the erosion resistant (or "ER") pocket. FIG. 11 illustrates a finished bit 130 that was cast from a mold manufactured using the milling process described herein to include an ER pocket. FIG. 11 shows a full view of the bit face with the PDC cutters 104 installed. It will be noted that an additional integral matrix material "hump" 132 has been added to the bit blade 134 toward the inside of the innermost cutter through the machining process at region 120 as described above. The method of machining used to create the "ER" pocket feature is the same method as described herein but with altered geometry to provide the needed shape of the hump though removal of graphite material at region 120.

Figure 12:
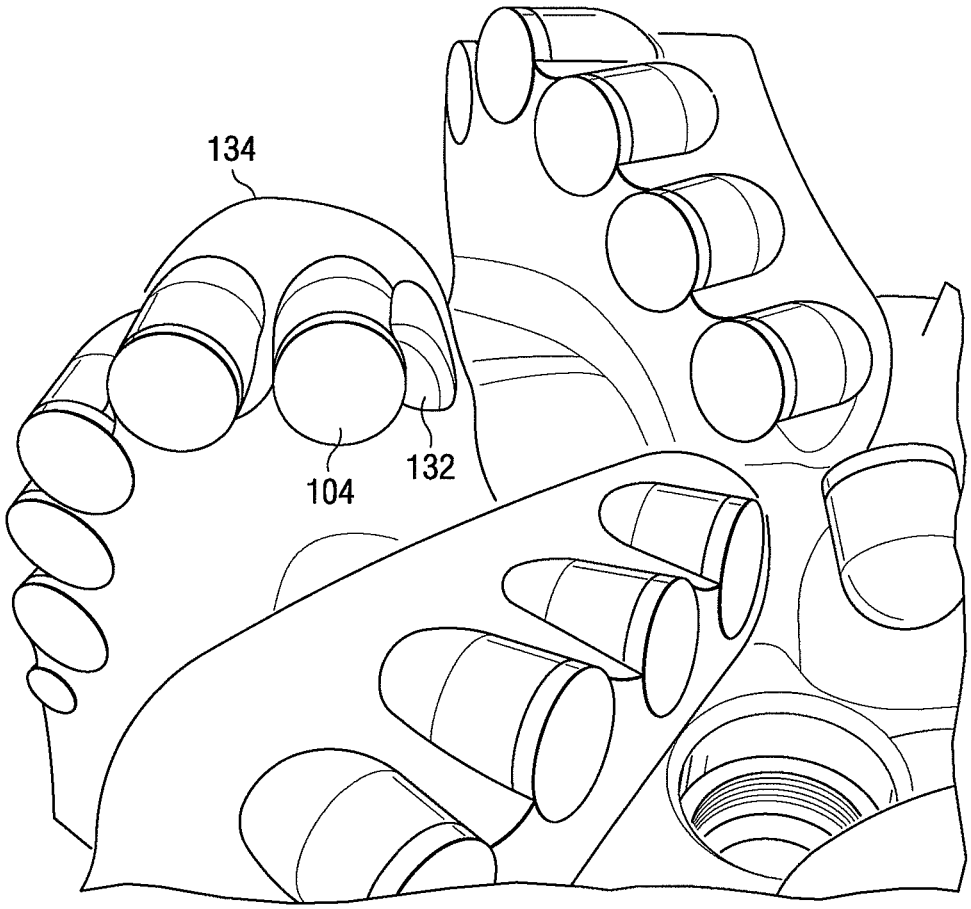
FIG. 12 illustrates a close-up view of a portion of FIG. 11.

FIG. 12 shows a close up view of FIG. 11 from a different angle and illustrates the bit blade 134 with the PDC cutters 104 installed and including the "ER" pocket. The additional integral material hump 132 on the innermost edge of the blade 134 provides an additional level of protection to the innermost (i.e., first) PDC cutter. The additional material at the inside end/edge of the blade helps to prevent premature matrix "washout" when the bit is used in connection with a highly abrasive drilling fluid.

Figure 13A:
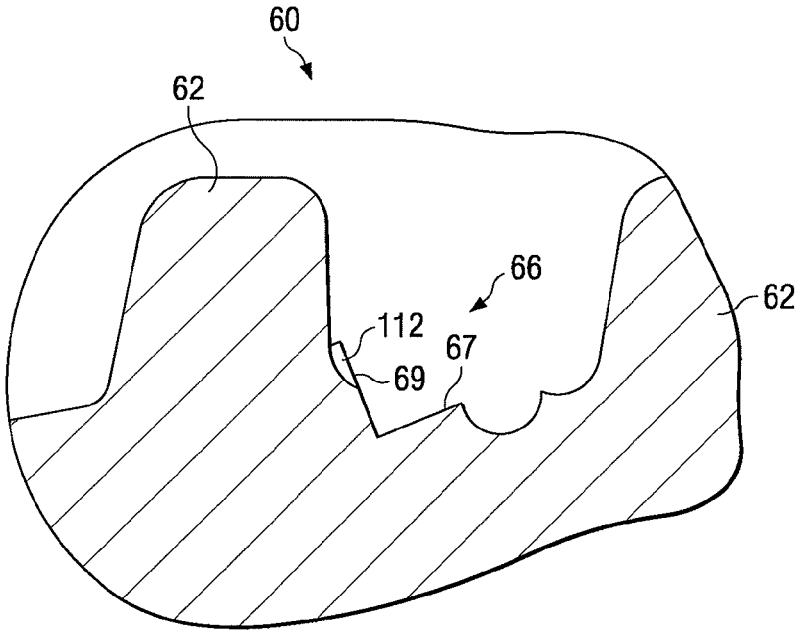
FIGS. 13A and 13B are cross-section views of part of an exemplary bottom portion mold component.
Figure 13B:
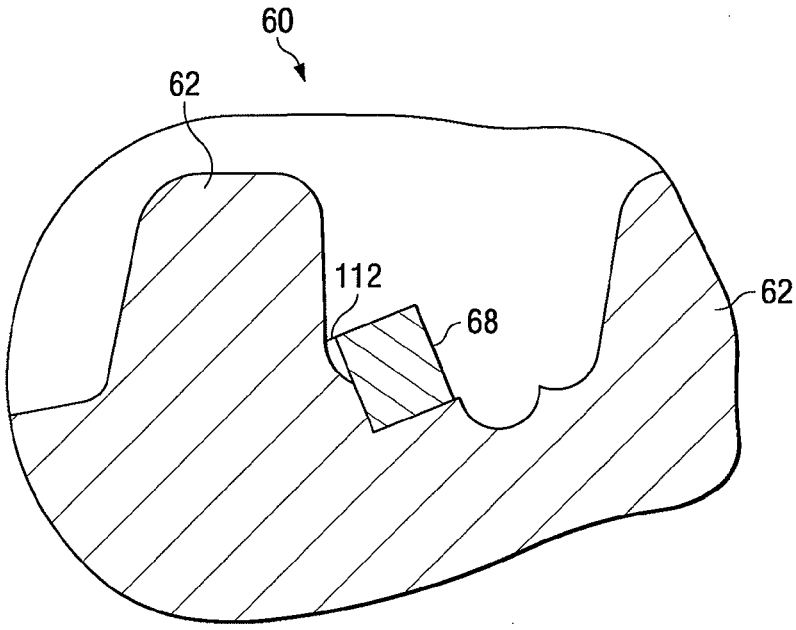

FIGS. 13A and 13B are cross-sectional views of a part of an exemplary bottom portion mold component 60 (associated with a standard pocket as described herein). FIG. 13A shows the cross-sectional view without the presence of an installed displacement cutter 68 core. FIG. 13B shows the cross-sectional view with the displacement cutter 68 core installed in the cutter pocket 66. FIGS. 13A and 13B further show the general placement of the facet 112 in the mold with respect to the cutter pocket 66. Again, the facet 112 is material left in the mold by the machining process at the face 69 of the pocket such that the face 69 provides a complete matching surface against which the front of the displacement rests. Because this material has been left in the mold at the facet 112, there is no need, with the match to the displacement, to use clay fill at the interface between the cutter core displacement and the junkslot former. The close fit of the displacement 68 within the machined pocket 66 is clearly shown by FIG. 13B.

Figure 14A:
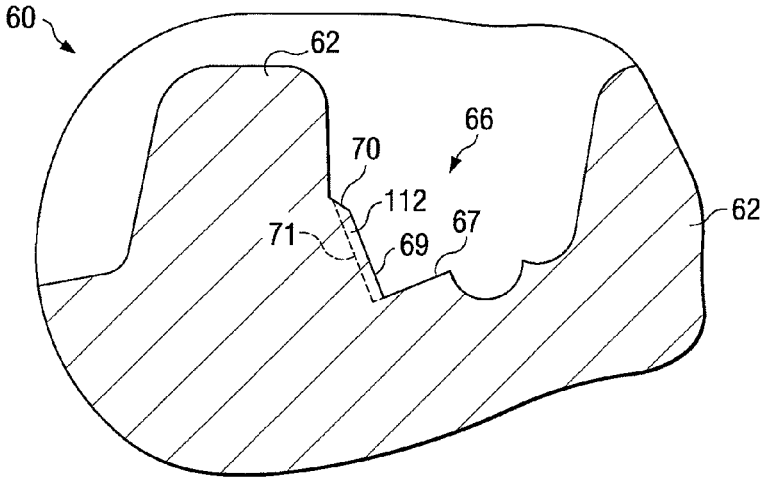
FIGS. 14A and 14B are cross-section views of part of an exemplary bottom portion mold component.
Figure 14B:
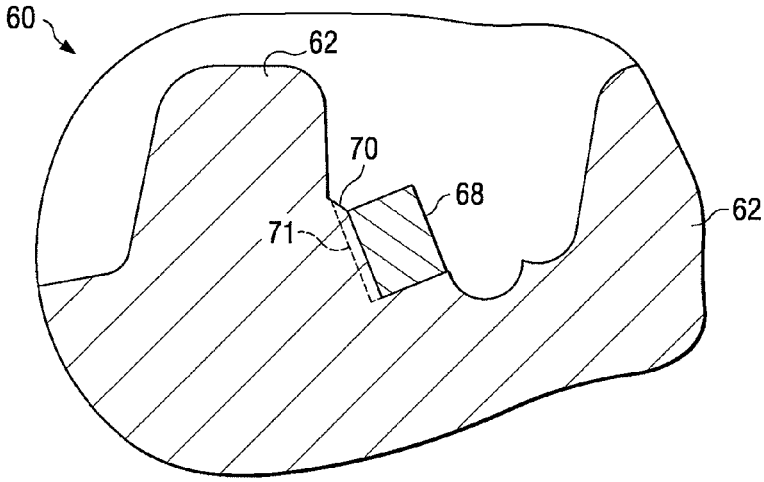

FIGS. 14A and 14B are cross-sectional views of a part of an exemplary bottom portion mold component 60 (associated with an UC pocket). FIG. 14A shows the cross-sectional view without the presence of an installed displacement cutter 68 core. FIG. 14B shows the cross-sectional view with the displacement cutter 68 core installed in the cutter pocket 66. FIGS. 14A and 14B further show the general placement of the facet 112 in the mold with respect to the cutter pocket 66 (see, discussion of FIGS. 13A and 13B). Additionally, FIGS. 14A and 14B show the general placement of the relief feature 70 associated with the region where the facet 112 is located. Again, the relief feature 70 is material left in the mold by the machining process at the face 69 of the pocket about at least a portion of the periphery of the face 69. Because this material has been left in the mold at the relief feature 70, this allows for the relief bevel 105 (see, FIG. 8) to formed in a manner which match with the displacement and obviates the need to use sculpted clay about the periphery of the displacement at the interface between the cutter core displacement and the junkslot former. Notice should be taken of the dotted line 71 which shows the relative position of the face 69 in comparison to FIGS. 13A and 13B. It will thus be noted that with the change in face 69 location that the core 68 used in FIG. 14B is shorter (in length) than the core 68 used in FIG. 13B. The use of a shortened core 68 in combination with the relief feature 70 will produce the relief bevel 105 (see, FIG. 8) when the PDC cutter, which is instead of the normal (not shortened) length, is installed into the bit.

Reference is once again made to FIG. 4 which shows that the mold can be configured to support formation of a blade with multiple rows of cutters per blade. It will be recognized that a facet feature can be provided in the mold with respect to any and all of the included rows of cutters. Before discussing this feature, however, reference is made to FIG. 15A which shows a cross-section through the bottom portion of a prior art mold in which a cutter pocket 32 in a secondary row has been provided. The cross-section is taken perpendicular to an axis of the displacement core 40 which is shown installed into the mold. In order to ensure an ease in bit assembly, and more specifically the top loading type installation of PDC cutters at pockets associated with the secondary row of the blade, a clay 44 fill is provided between the bottom surface of the mold and the peripheral circumferential sides of the installed displacement core 40. Again, it would be advantageous if the labor associated with the sculpting of fill at each installed displacement core 40 could be avoided.

Figure 15B:
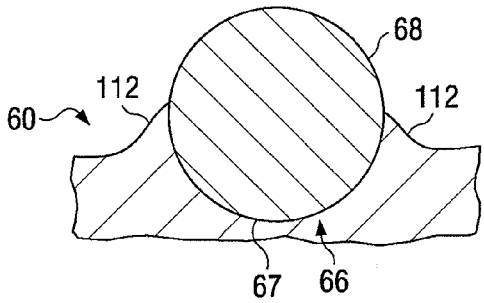
FIG. 15B is a cross-section view of part of an exemplary bottom portion mold component associated with a secondary row of cutter pockets.

Reference is now made to FIG. 15B which shows a cross-section through the bottom portion of a mold formed in accordance with the techniques described herein. More specifically, the precise machining techniques and processes used to form cutter pockets for the primary row of cutters at the junkslot former can be used with respect to the secondary row of cutters as well in order to leave material in the mold on either side of the pocket. A cutter pocket 66 is formed by the machining process, each pocket including a seat 67 and a face (not shown in this cross-sectional view). To assist in better understanding the configuration of the bottom portion mold component 60 of the bit mold as a result of the machining process, the installation of a graphite displacement 68 in one of the cutter pockets 66 (the cylindrical circumferential surface of which resting in the seat 67). It will be noted how, due to the controlled milling process, the graphite displacement 68 closely conforms to the shape of the machined cutter pocket 66 (this view especially showing the seat 67), and further the controlled milling process to define a facet 112 in the blade area on either side of the pocket 66. This facet 112 is used to achieve a "clay-less" cutter core displacement assembly (i.e., the facet provides non-milled graphite material left in the mold itself at cutter pocket locations on either side of where the displacement will be located which obviates the need to install and sculpt clay on the mold in order to address issues with respect to ease of top loading at secondary cutter locations).

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A method for manufacturing a drill bit mold, comprising:
milling into a mold component a set of junkslot formers separated by blade regions;
milling a plurality of cutter pockets each comprising a seat portion and a face portion, wherein the face portion at one or more of the cutter pockets includes a milled face surface and a milled relief feature at least partially surrounding a periphery of the milled face surface; and
installing a cutter core displacement at the one or more of the cutter pockets, the cutter core displacement having an outer surface conforming to the seat portion and lacking a peripheral relief feature and having an end surface which, due to the presence of the face surface, matches the face portion such that the entire end surface of the installed cutter core displacement rests against the face surface of the cutter pocket with the milled relief feature at least partially surrounding the end surface of the installed cutter core displacement.

2. The method of claim 1 further comprising milling into at least one blade region, at an inner end of the blade region adjacent an innermost cutter pocket, an erosion resistant pocket region.

3. The method of claim 2 wherein the erosion resistant pocket region has a configuration for defining a washout protection feature an the inner end of a blade in a product cast from the bit drill bit mold.

4. The method of claim 1 further comprising milling, at one or more of the cutter pockets, a shock stud bump feature.

5. The method of claim 1 wherein the relief feature has a configuration for defining a relief bevel at least partially peripherally about a cutter installed at the cutter pocket in a product cast from the bit drill bit mold.

6. The method of claim 1 wherein milling into the blade regions a plurality of cutter pockets comprises milling cutter pockets in a single row per blade region configuration.

7. The method of claim 1 wherein milling into the blade regions a plurality of cutter pockets comprises milling cutter pockets in plural rows per blade region configuration.

8. The method of claim 1 further comprising milling a gagering component to include a set of junkslot formers for alignment with set of junkslot formers in the mold component, wherein the gagering component is interfaced and aligned with the milling component.

9. The method of claim 8 wherein the mold and gagering components are made of a graphite material.

10. The method of claim 1 further comprising milling into the mold component features associated with fluid passages and cutter backup features.

11. A method for manufacturing a drill bit, comprising:
forming a drill bit mold, comprising:
milling into a mold component a set of junkslot formers separated by blade regions;
milling a plurality of cutter pockets each comprising a seat portion and a face portion, wherein the face portion at one or more of the cutter pockets includes a milled face surface and a milled relief feature at least partially surrounding a periphery of the milled face surface; and
installing a cutter core displacement at the one or more of the cutter pockets, the cutter core displacement having an outer surface conforming to the seat portion and lacking a peripheral relief feature and having an end surface which, due to the presence of the face surface, matches the face portion such that the entire end surface of the installed cutter core displacement rests against the face surface of the cutter pocket with the milled relief feature at least partially surrounding the end surface of the installed cutter core displacement;
filling the drill bit mold with a casting material;
removing the drill bit mold to release a cast object; and
replacing the cutter core displacements in the cast object with PDC cutter elements wherein the milled relief feature provides a relief bevel in the cast object at least partially surrounding a peripheral edge of the PDC cutter element.

12. The method of claim 11 wherein forming a drill bit mold further comprises milling into at least one blade region, at an inner end of the blade region adjacent an innermost cutter pocket, an erosion resistant pocket region, the cast object possessing a material portion defining a washout protection feature an the inner end of a blade in the cast object.

13. The method of claim 11 wherein forming a drill bit mold further comprises milling, at one or more of the cutter pockets, a shock stud bump feature, the cast object possessing a shock stud bump behind cutter pockets for receiving PDC cutter elements.

14. The method of claim 11 wherein milling into the blade regions a plurality of cutter pockets comprises milling cutter pockets in a single row per blade region configuration.

15. The method of claim 11 wherein milling into the blade regions a plurality of cutter pockets comprises milling cutter pockets in plural rows per blade region configuration.

16. The method of claim 11 wherein forming a drill bit mold further comprises milling a gagering component to include a set of junkslot formers for alignment with set of junkslot formers in the mold component.

17. The method of claim 16 wherein the mold and gagering components are made of a graphite material.

18. A method, comprising:

milling into a junkslot former of a drill bit mold a plurality of cutter pockets each comprising a seat portion and a face portion, wherein the face portion includes a milled face surface and a milled relief feature at least partially surrounding a periphery of the milled face surface; and installing a cutter core displacement in each cutter pocket, the cutter core displacement having an outer surface conforming to the seat portion and lacking a peripheral relief feature and having an end surface which, due to the presence of the face surface matches the face portion such that the entire end surface of the installed cutter core displacement rests against the face surface of the cutter pocket with the milled relief feature at least partially surrounding the end surface of the installed cutter core displacement.

19. The method of claim 18 wherein the relief feature has a configuration for defining a relief bevel a product cast from the bit drill bit mold that at least partially peripherally surrounds a cutter installed at each cutter pocket in place of the cutter core displacement.

20. The method of claim 19 wherein the seat portion of the cutter pocket includes a first length, the cutter core displacement has a second length substantially equal to the first length, and the installed cutter has a third length greater than the first and second lengths.

21. The method of claim 20 wherein the milled relief feature has a depth, and the depth plus the first length is substantially equal to the third length.

22. The method of claim 18 wherein the milled relief feature comprises a sloped surface extending from a peripheral edge of the milled face surface.

23. The method of claim 22 wherein the milled face surface has a circular configuration defining the peripheral edge and matching in size and shape a circular configuration of the end surface of the cutter core displacement.

* * * * *